US006676583B2

(12) United States Patent
Walsh

(10) Patent No.: US 6,676,583 B2
(45) Date of Patent: Jan. 13, 2004

(54) WEB OF MATERIAL HAVING LAYERS AND A METHOD OF FORMING ONE OR MORE CARTON BLANKS FROM THE MATERIAL

(75) Inventor: Joseph C. Walsh, Boulder, CO (US)

(73) Assignee: Graphic Packaging International, Inc., Marietta, GA (US)

( * ) Notice: Subject to any disclaimer, the term of this patent is extended or adjusted under 35 U.S.C. 154(b) by 15 days.

(21) Appl. No.: 10/021,514

(22) Filed: Dec. 7, 2001

(65) Prior Publication Data

US 2003/0109366 A1 Jun. 12, 2003

(51) Int. Cl.[7] ..... B31B 1/26
(52) U.S. Cl. ..... 493/51; 493/132; 493/162
(58) Field of Search ..... 493/95–99, 110, 493/132, 162, 183, 337, 907

(56) References Cited

U.S. PATENT DOCUMENTS 1,341,954 A * 6/1920 Weightman et al. ..... 493/110
1,591,061 A * 7/1926 Smith ..... 229/164.1
1,745,385 A * 2/1930 Smith ..... 493/68
1,762,702 A * 6/1930 Smith ..... 493/60
2,016,754 A * 10/1935 Perkit ..... 493/356
2,432,054 A * 12/1947 Waters ..... 493/56
3,147,675 A * 9/1964 Cherrin ..... 493/63
3,399,096 A 8/1968 Ranger
3,750,538 A 8/1973 Confer
3,810,813 A * 5/1974 Ellis ..... 428/172
3,951,333 A * 4/1976 Forbes et al. ..... 229/207
5,632,402 A 5/1997 Walsh et al.
5,632,404 A 5/1997 Walsh
5,783,030 A 7/1998 Walsh
5,794,811 A 8/1998 Walsh
5,794,812 A 8/1998 Walsh

OTHER PUBLICATIONS

U.S. patent application Ser. No. 09/864,567 filed May 24, 2001 for "Carton Blank And Method Of Forming A Carton Blank" of Joseph C. Walsh.

* cited by examiner

*Primary Examiner*—Scott A. Smith
*Assistant Examiner*—Nathaniel Chukwurah
(74) *Attorney, Agent, or Firm*—Klaas, Law, O'Meara & Malkin, P.C.; Michael A. Goodwin; Stephen B. Katsaros

(57) ABSTRACT

Disclosed herein is a web of material having a relatively rigid layer and a relatively flexible layer and a method of forming one or more carton blanks from such material.

13 Claims, 6 Drawing Sheets

WEB OF MATERIAL HAVING LAYERS AND A METHOD OF FORMING ONE OR MORE CARTON BLANKS FROM THE MATERIAL

FIELD

The disclosure herein is directed generally to materials for forming carton blanks and methods of forming carton blanks from such materials.

BACKGROUND

Once, primarily used to package the aggressive surfactants of concentrated detergents, laminate film packaging is now used for numerous applications including: soap boxes, cereal boxes, bottle carriers, can boxes, etc.

The components of laminate film packaging generally include a layer of printed film and a layer of paperboard. The paperboard serves as a substrate to which the film layer is laminated. Film provides strength to the composition, therefore allowing for thinner, recycled, or otherwise lower strength paperboard to be used. Laminate film packaging is environmentally sound because in many situations it is made from post-consumer recycled fibers and is itself recyclable. Products packaged in laminate film packaging may have lower contamination levels due to the barrier properties of the film, resulting in products staying fresher longer and reaching the end-user in better condition.

Laminate film packaging is often made from recycled materials. In many cases, the paperboard is a Double-Kraft Lined (DKL) product. DKL paperboard consists of mixed fibers in the inner plies with one ply of Kraft on either side for strength.

Typically, the film used for laminate film packaging is polyethylene (PE), polypropylene (PP), or polyethylene terephthalate (PET). The film may optionally be provided with a unique visual characteristic such as a holographic or mearl pattern. The film may be surface printed or reverse printed with graphics. The film improves the aesthetics while adding extra strength to the paperboard.

An optional metalization layer deposited on the laminate film may further improve aesthetics of the laminate film package. The optional metalization layer may be included to provide a barrier layer for improved graphics. The improved graphics is a result of the reflectivity of the metalization layer. The metalization layer may be provided on a surface of the film by vapor deposition and is commonly an aluminum layer.

The term 'web' is commonly used in the packaging industry to refer to a large roll of material to which various processes (e.g. printing and surface treatments, cutting, scoring, etc.) are provided. One such process is the cutting of blanks from the web of material.

After separating blanks from the web of material, the blanks may be inserted into a separate machine or in-line section of a continuous machine for gluing and folding (often referred to as a folder/gluer machine). Gluing and folding is often completed while the package is moving at a somewhat relatively high speed in a progressive, continuous manner.

While traveling through the folder/gluer machine, adhesive is used to erect packages from the laminate film carton blanks. Two types of adhesive are conventionally used. The first type of adhesive is cold glue and the second type is hot glue.

Cold glue is typically in the form of an adhesive dissolved in a volatile carrier. The cold glue is generally applied to the laminate film packaging in a wet condition. Upon assembling the packaging, the volatile carrier is wicked from the adhesive into the paperboard or evaporated. The resulting dry adhesive provides tack to attach one section of the packaging to another. Since the volatile carrier needs to be removed from the cold glue, cold glue typically works better on plain paperboard (i.e. without film). The cold glue works sufficiently well when attaching laminate film packaging where a paperboard-to-paperboard attachment is required. Additionally, the packaging may be assembled with cold glue having a film-to-paperboard attachment. It is difficult, however, to obtain a satisfactory film-to-film attachment using cold glue due to the required removal of the volatile carrier. Cold glue may be dispensed from a nozzle or a cold glue pot. The nozzle for cold glue is often controlled by a solenoid that is actuated by a control system. The cold glue pot is a pad-printing device wherein a rotating pad has a raised area. The raised area picks-up glue from the glue pot and transfers it to the packaging.

Hot glue is an adhesive that is semi-fluid when hot and semi-solid when cold. The hot glue is applied hot to packaging. Before the hot glue cools, the packaging is assembled. The hot glue is then cooled to provide an attachment between the two parts of the package. The hot glue provides a sufficient bond on film-to-film applications as well as paperboard-to-film and paperboard-to-paperboard attachment. Hot glue is most commonly dispensed from a nozzle. The nozzle is typically actuated by a solenoid that is controlled by a control system.

SUMMARY

In one exemplary embodiment, the present disclosure is directed to a method of making at least one carton blank, the method comprising: providing a relatively rigid material comprising: a first portion; a first edge and an oppositely disposed second edge defining a first width formed between the first edge and the second edge; providing a relatively flexible fluid impervious material comprising: a second portion; a third edge and an oppositely disposed fourth edge defining a second width formed between the third edge and the fourth edge; wherein the second width is less than the first width; adhering the first portion to the second portion, thereby defining a web of material; and separating the at least one carton blank from the web of material.

In another exemplary embodiment, the present disclosure is directed to a web of material from which carton blanks are separated comprising: a relatively rigid material comprising: a first portion; a second portion adjacent to the first portion; a first edge and an oppositely disposed second edge defining a first width formed between the first edge and the second edge; a relatively flexible fluid impervious material comprising: a third portion; a fourth portion adjacent to the third portion; a third edge and an oppositely disposed fourth edge defining a second width formed between the third edge and the fourth edge; wherein the second width is less than the first width; wherein the second portion is adhered to the first portion; and wherein the second portion is immediately adjacent to the fourth portion but not adhered to the fourth portion.

In another exemplary embodiment, the present disclosure is directed to a web of material from which carton blanks are separated comprising: a relatively rigid material comprising at least a first portion and a second portion; a relatively flexible fluid impervious material having at least a third portion and a fourth portion; wherein the web of material comprises at least a first condition and a second condition;

wherein, in the first condition: the first portion is adhered to the third portion; and the second portion is immediately adjacent to the fourth portion but not adhered to the fourth portion; wherein, in the second condition; the first portion is adhered to the third portion; the fourth portion is not immediately adjacent to the second portion; and the fourth portion is at least partially separated from the third portion.

In another exemplary embodiment, the present disclosure is directed to a method of forming carton blanks, the method comprising: providing a relatively rigid material comprising at least a first portion and a second portion; providing a relatively flexible fluid impervious material having at least a third portion and a fourth portion; adhering the first portion to the third portion, thereby defining a web of material; and locating the second portion immediately adjacent to the fourth portion but not adhering the second portion to the fourth portion; at least partially separating the fourth portion from the third portion; and separating the at least one carton blank from the web of material.

BRIEF DESCRIPTION OF THE DRAWINGS

Illustrative and presently preferred embodiments are illustrated in the drawings in which.

DESCRIPTION

Described herein is a web of material, apparatus for making the web of material and a method for producing blanks for containers from the web of material. The apparatus and method may be utilized for any one of a plurality of containers (e.g., consumer packaging, shipping packaging, point-of-purchase display packaging, etc). One such container is a bottle carrier (e.g. 90, FIG. 1) used to carry bottles. The description herein is directed to the exemplary bottle carrier. It is noted, however, that this description is for descriptive purposes only. It is further noted that the present apparatus and method may be adapted to be utilized for any one of a number of containers as appreciated by those skilled in the art.

Figure 1:
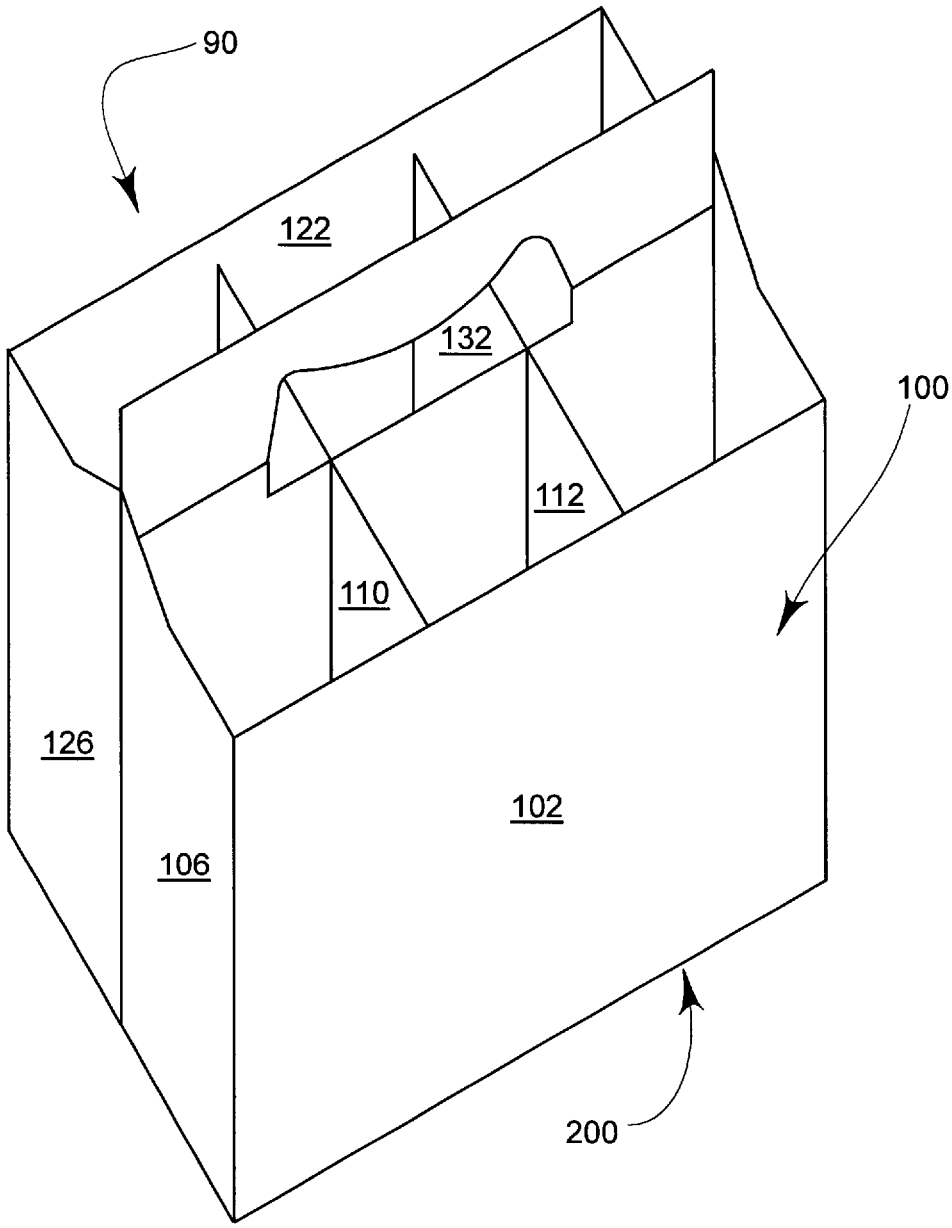
FIG. 1 shows a perspective view of an exemplary erected bottle carrier.
Figure 2:
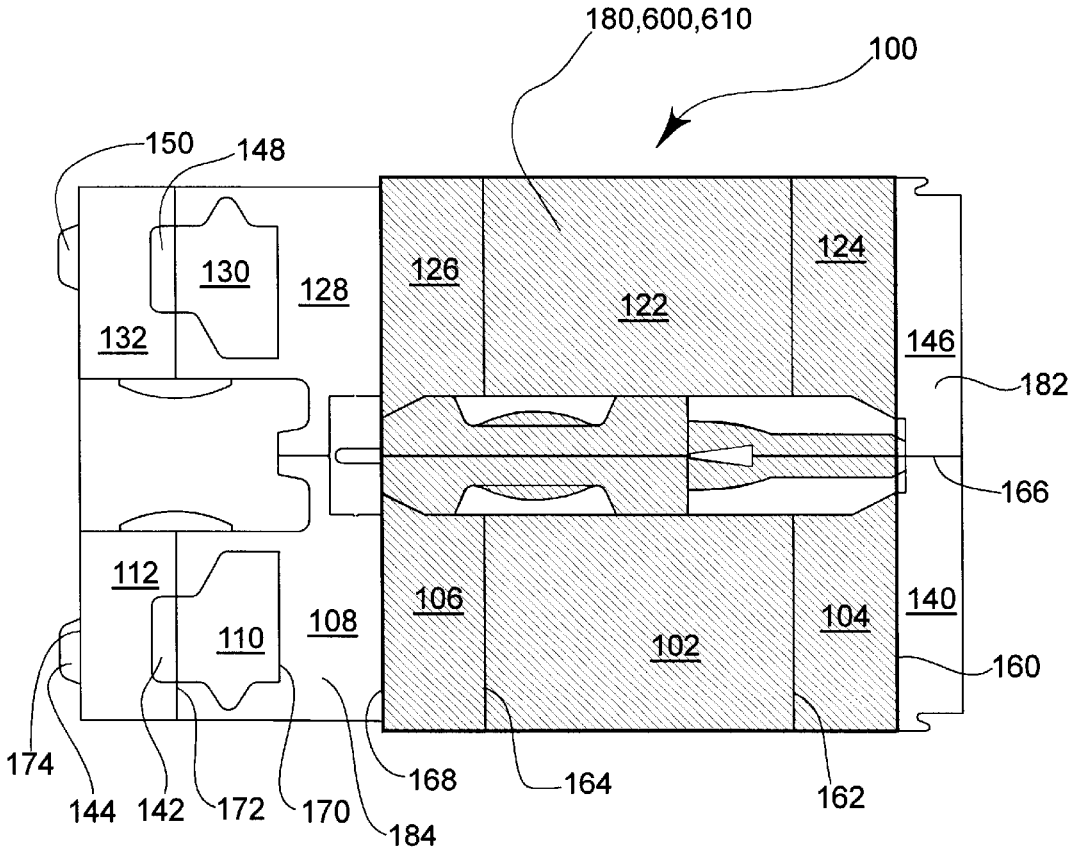
FIG. 2 shows a top plan view of a blank from which the bottle carrier of FIG. 1 is constructed.
Figure 3:
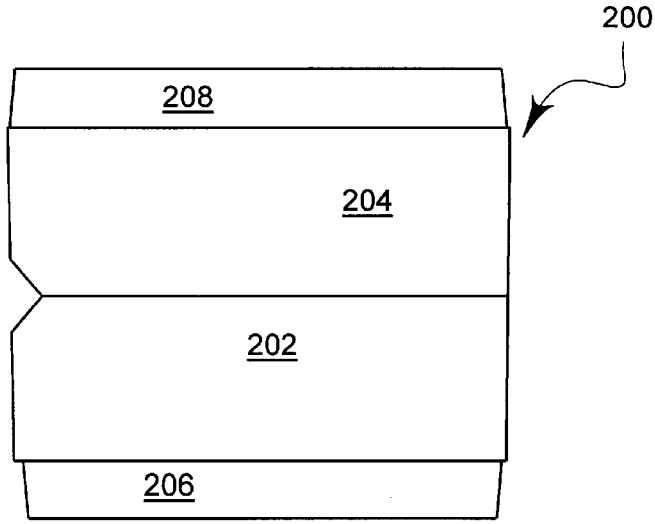
FIG. 3 shows a top plan view of a bottom portion of the bottle carrier of FIG. 1.

As previously mentioned, one exemplary container manufactured with the present apparatus and method is a bottle carrier 90 shown in FIG. 1. With reference to FIG. 2, the bottle carrier 90 may be manufactured from a blank 100 and a bottom portion 200 (FIG. 3). The blank 100 may be provided with a plurality of panels and fold lines. The blank 100 may be provided with a front panel 102, a right front panel 104, a left front panel 106, a front partition carrier panel 108, a first front partition 110 and a second front partition 112. The blank 100 may be further provided with a back panel 122, a right back panel 124, a left back panel 126, a back partition carrier panel 128, a first back partition 130 and a second back partition 132. The blank 100 may be further provided with a plurality of glue flaps such as a right front glue flap 140, a first front partition glue flap 142, a second front partition glue flap 144, a right back glue flap 146, a first back partition glue flap 148, a second front partition glue flap 150. The blank 100 may be further provided with a plurality of fold lines such as fold lines 160, 162, 164, 166, 168, 170, 172 and 174. It is noted that the fold lines identified above are not an exhaustive list. These fold lines are specifically identified for descriptive purposes only and it is noted that additional fold lines may exist as shown, for example, in the figures. The blank 100 may be further provided with a printed film portion 180 (as shown in FIG. 2 as a shaded area) and a plurality of paperboard portions such as exposed paperboard portions 182, 184. The term 'exposed paperboard portions' is herein defined as areas of paperboard that are not covered by film. The particular attributes of the film portion 180 and the paperboard portions 182, 184 will be discussed later herein; however, in brief, the portions 180, 182, 184 are provided for reasons of adhesion requirements during the conversion from the blank 100 to the bottle carrier 90 (FIG. 1).

As shown in FIG. 1, the bottle carrier 90 may be provided with a bottom portion 200. The bottom portion 200 is provided with a plurality of panels and fold lines. With reference to FIG. 3, the bottom portion 200 may be provided with a front bottom panel 202 and a back bottom panel 204. The bottom portion 200 may be further provided with a plurality of glue flaps such as a front glue portion 206 and a back glue portion 208. Additionally, the bottom portion 200 may be provided with a printed film portion (not shown) or simply be plain paperboard, depending on the desired cosmetic appearance or the desired mechanical properties of the bottle carrier 90.

The process of manufacturing and assembling a variety of containers, is discussed, for example, in the following: U.S. patent application Ser. No. 09/864,567 for a CARTON BLANK AND METHOD OF FORMING A CARTON of Joseph C. Walsh filed on May 24, 2001 and U.S. patent application Ser. No. 09/877,336 for a TRANSFER GLUE SYSTEM AND METHOD FOR A RIGHT ANGLE GLUING MACHINE of Joseph C. Walsh et al. filed on Jun. 8, 2001; both of which are hereby specifically incorporated by reference for all that is taught and contained therein.

The bottle carrier 90 may be manufactured by a variety of methods. One such method may be utilization of a web processing center 400 (FIGS. 4 and 5) and a folder/gluer machine (not shown). By utilizing the web processing center 400 and the folder/gluer machine, the bottle carrier 90 may be manufactured by making the blank 100 and the bottom portion 200, and erecting the blank 100 and bottom portion 200. The process of making the blank 100 and the bottom portion 200 will now be described.

Figure 4:
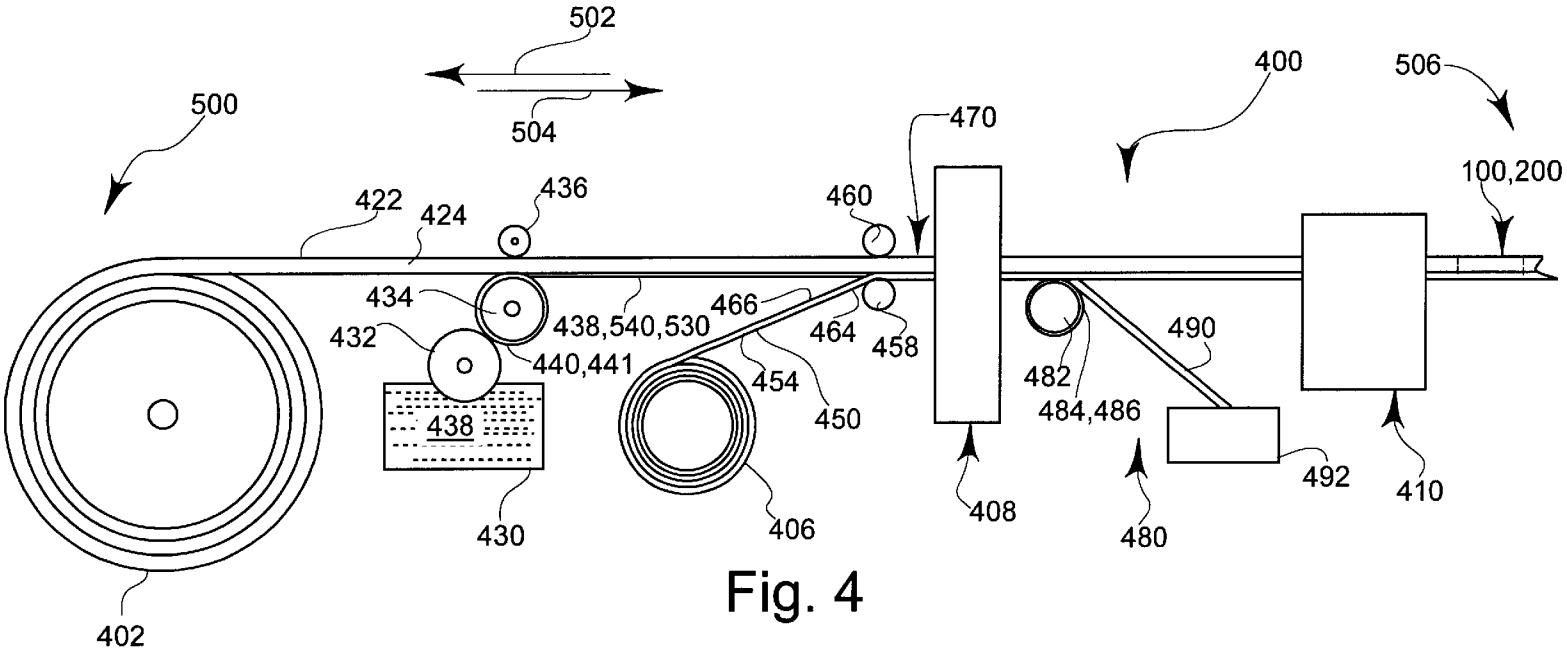
FIG. 4 shows a schematic side elevation view of a web processing center.
Figure 5:
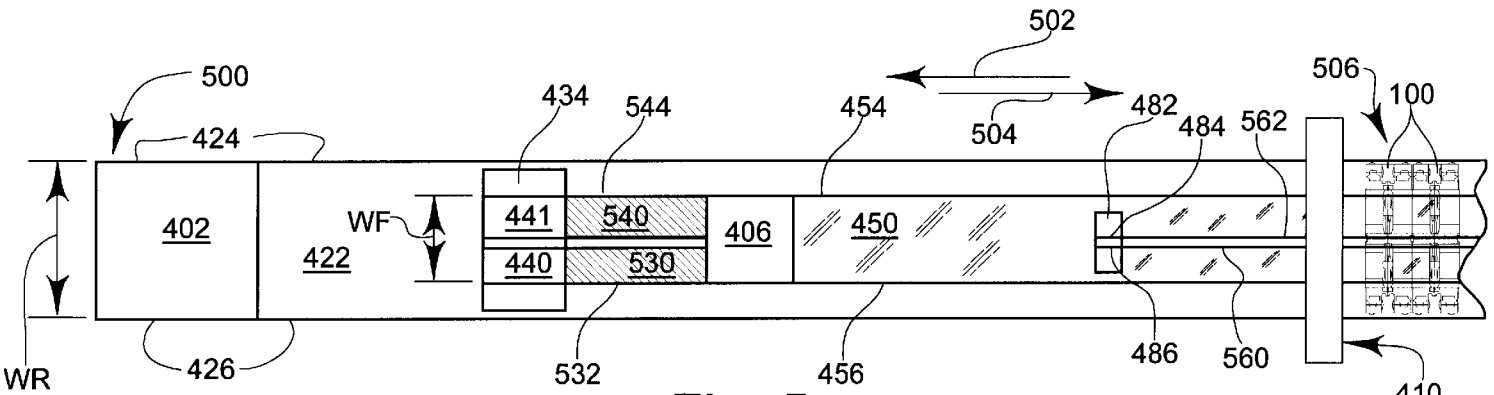
FIG. 5 shows a schematic bottom plan view of the web processing center of FIG. 4.

The blank 100 and the bottom portion 200 may be manufactured by a web processing center. One exemplary web processing center 400 is shown schematically in FIGS. 4 and 5. FIGS. 4 and 5 show the web processing center 400 in a schematic side elevation view and a schematic bottom plan view, respectively. The web processing center 400 receives raw materials, such as paperboard, film, adhesive and ink, and converts the raw materials into blanks 100 and bottom portions 200. Additionally and with respect to FIG. 4, the web processing center 400 may generally define an upstream portion 500 and a downstream portion 506. The downstream portion 506 is located in a downstream direction 504 from the upstream portion 500. The downstream direction 504 generally refers to the flow of material in the web processing center 400. The upstream portion 500 is located in an upstream direction 502 from the downstream portion 506. Therefore, the upstream direction 502 is oppositely disposed from the downstream direction 504.

With further reference to FIG. 4, the web processing center 400 may be provided with a roll 402 of a relatively rigid material mounted so that a continuous strip 422 may be removed therefrom. The roll 402 and continuous strip 422 of relatively rigid material may be hereinafter also referred to as the relatively rigid material 402, 422. The roll 402 and the continuous strip 422 of relatively rigid material may be any one of a variety of rigid materials, for example a paperboard material such as 0.021 inch single or Double-Kraft lined (DKL) recycled or natural Kraft board. The roll 402 and the continuous strip 422 of relatively rigid material have a rigid material first edge 424 and an oppositely disposed rigid material second edge 426 (FIG. 5). The rigid material first and second edges 424, 426 define a rigid material width "WR" (FIG. 5) externally therebetween. The relatively rigid material 422 may be fed between a driven gravure roll 434 and an idler pressure applying roll 436. A supply tank 430 may be mounted at a fixed location and may contain a supply of a suitable adhesive material 438. Suitable adhesive materials may be any one of a variety of adhesives capable of being applied to the relatively rigid material 422 and thereafter bonding other materials to the relatively rigid material 422. Suitable adhesive materials 438 include, but are not limited to, hot adhesives (e.g. polyethylene, ethyl vinyl acetate (EVA), etc.) and cold adhesives (e.g. starch adhesives, liquid adhesives, etc.). A transfer roll 432 may be rotatably mounted to pass through the adhesive material 438 and then to any number of raised surfaces such as raised surfaces 440, 441 of the gravure roll 434 to coat the raised surfaces 440, 441 with the adhesive material 438. Although the gravure roll 434 is shown in this exemplary embodiment, it is understood that other types of conventional laminating apparatus may be used to apply the adhesive material 438 to the continuous strip of relatively rigid material 422. Other alternative methods for adhering film to paperboard include flexographic printing and radiation cure products (e.g. ultraviolet curable adhesives, electron beam adhesives, etc.)

The web processing center 400 may be further provided with a roll 406 of a relatively fluid impervious material so that a continuous strip 450 may be removed therefrom. The roll 406 and continuous strip 450 of relatively fluid impervious material may hereinafter also be referred to as relatively fluid impervious material 406, 450. The roll 406 and continuous strip 450 of relatively fluid impervious material may be any one of a number of materials capable of providing a barrier from one side to another side thereof. Examples of relatively fluid impervious materials 406, 450 include, but are not limited to, polyethylene, polypropylene, polyester, or other polymer equivalents having somewhat fluid impervious properties. Additionally, the roll 406 and the continuous strip 450 of relatively fluid impervious material have a fluid impervious material first edge 454 and an oppositely disposed fluid impervious material second edge 456 (FIG. 5). The fluid impervious material first and second edges 454, 456 define a fluid impervious material width "WF" (FIG. 5) extending therebetween. The relatively fluid impervious material 450 may be adhesively attached to the relatively rigid material 422 by the adhesive material 438. The assembly of the relatively rigid material 422 and the relatively fluid impervious material 450 may be referred to as an assembled web 470. The adhesion may be promoted by a pair of idler pressure applying rolls 458, 460. The idler pressure applying rolls 458, 460 press the relatively fluid impervious material 450 against the adhesive material 438 disposed on the relatively rigid material 422, thereby adhesively joining the relatively fluid impervious material 450 to the relatively rigid material 422.

The web processing center 400 may be further provided with a printing center 408. The printing center 408 is shown in FIG. 4 as printing on an external side 464 of the relatively fluid impervious material 450. In an alternative configuration, the printing center 408 may print on an internal side 466 of the relatively fluid impervious material 450 by placing the printing center before the idle rollers 458, 460.

The web processing center 400 may be further provided with a film stripping center 480. The film stripping center 480 may remove various sections (e.g. detached portion 490) of the relatively fluid impervious material 450 from the assembled web 470. In order to remove a section of the relatively fluid impervious material 450, it is preferred that sections to be removed (e.g. detached portion 490) not be adhesively attached to the relatively rigid material 422. For this purpose, the raised surfaces (e.g., 440, 441) or the gravure roll 434 may be located only in selected areas so that adhesive is not applied to at least one predetermined portion of the relatively rigid material 422. The film stripping center 480 may be provided with any one of a variety of film cutters such as a rotary knife 482. The rotary knife 482 may be provided with a plurality of knives such as a first knife 484 and a second knife 486; the knives 484, 486 being provided to separate a portion of detached film 490 from the relatively fluid impervious material 450 which is a subcomponent of the assembled web 470. The film stripping center 480 may be further provided with a collection center 492 provided for receiving the detached film 490. The detached film 490 that is collected in the collection center 492 may be discarded or recycled.

The web processing center 400 may be further provided with a blanking center 410. Alternatively, the blanking center 410 may be separate from the web processing center 400, whereby a web of material (e.g. 470) is transported (commonly in a roll) from the web processing center 400 to the blanking center 410. The blanking center 410 may be any one of a variety of cutting centers known in the art. One such blanking center 410 may include a rotary cutter (not shown). The rotary cutter 'rolls' with the assembled web 470; as the rotary cutter rolls, knives provided on the rotary cutter penetrate the assembled web 470 and separate various portions thereof. Such portions separated from the assembled web may include the blank 100 and the bottom portion 200.

After making the blank 100 and the bottom portion 200 in the web processing center 400, the blank 100 and bottom portion 200 are introduced into the folder/gluer machine (not shown). The folder/gluer machine is utilized for folding and gluing the blank 100 and the bottom portion 200 to erect the bottle carrier 90 (FIG. 1). Folding and gluing of the present exemplary package may, for example, be substantially similar to the process described in U.S. patent application Ser.

No. 09/877,336 for a TRANSFER GLUE SYSTEM AND METHOD FOR A RIGHT ANGLE GLUING MACHINE of Joseph C. Walsh et al. filed on Jun. 8, 2001, as previously referenced.

An exemplary process of manufacturing the blank 100 will now be detailed. Prior to running the web processing center 400, container blanks are designed and nested. Nesting blanks on a web may be controlled by a number of requirements. One such requirement may be the maximization of material usage. Another requirement may be the location of features within the web for processing concerns. Blanks may have surfaces that require film and graphics printed thereon; these film and graphics surfaces may comprise less area than the entire area of the blank. As such, the opportunity exists to nest and process blanks such that film and graphics are applied to only areas which require the film and graphics. Areas that may require film and graphics are areas that are visible in an as-erected state (e.g., bottle carrier 90). Additionally, blanks may be oriented such that areas that are attached with adhesive to each other in the folder/gluer machine may remain uncoated by film, thereby promoting adhesion between two surfaces. This adhesion promotion between two surfaces has been previously discussed in the background section; however, in brief, adhesion between two paperboard surfaces with cold glue is preferable over adhesion between relatively rigid material such as paperboard and relatively fluid impervious material such as film with cold glue.

Figure 10:
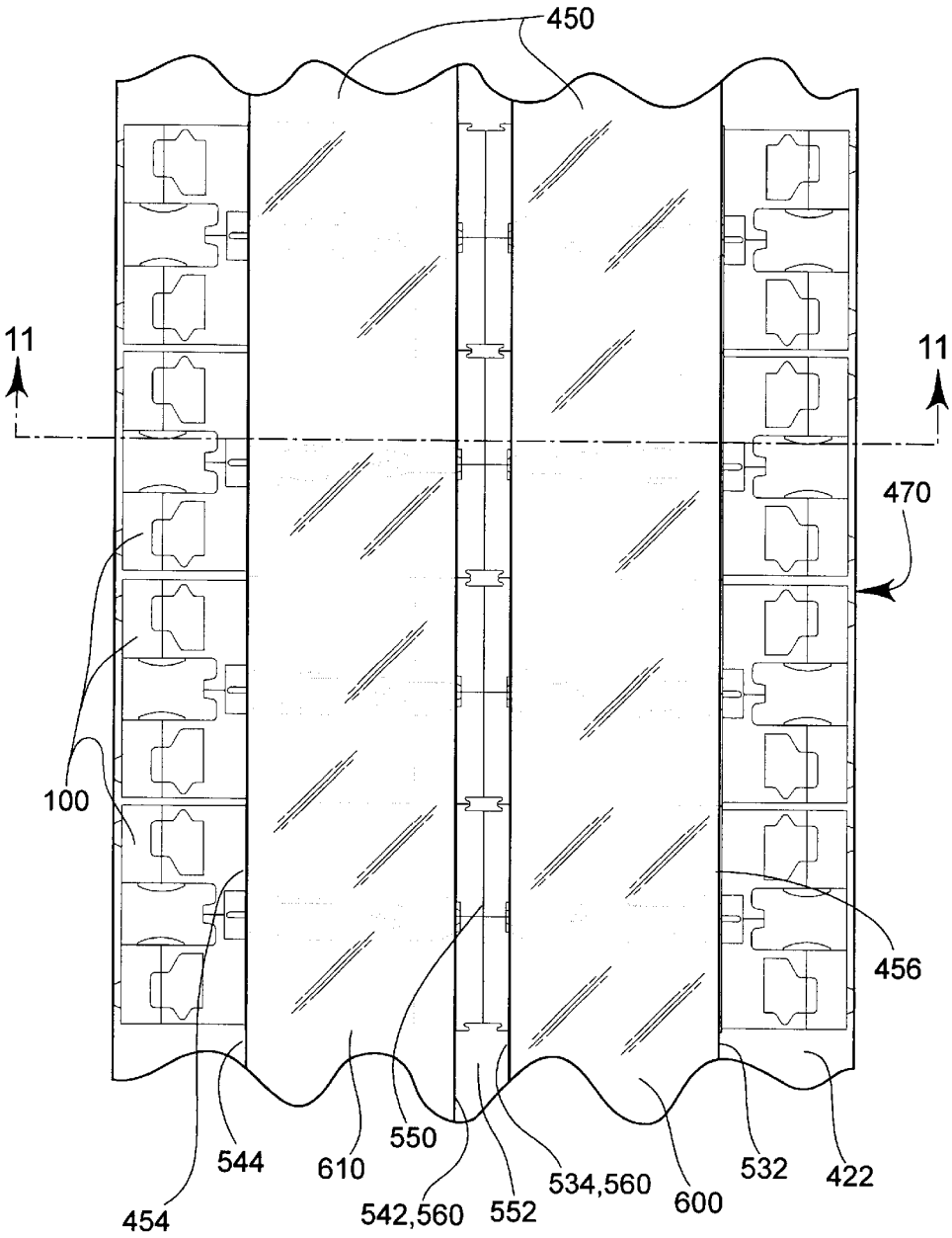
FIG. 10 shows a top plan view of the web of material of FIG. 8 having a detached portion of the relatively fluid impervious material removed therefrom.

Having provided a description of the nesting of blanks on the assembled web 470, a description of the process of manufacturing the assembled web 470 will be provided herein. As shown in FIG. 10, a plurality of blanks such as blank 100 (detailed in FIG. 2) may be nested on the assembled web 470 of material. The assembled web 470 in the present description includes the relatively rigid material 422 and the relatively fluid impervious material 450. The blanks 100 may be nested to minimize the amount of detached film 490 (FIG. 4).

Figure 9:
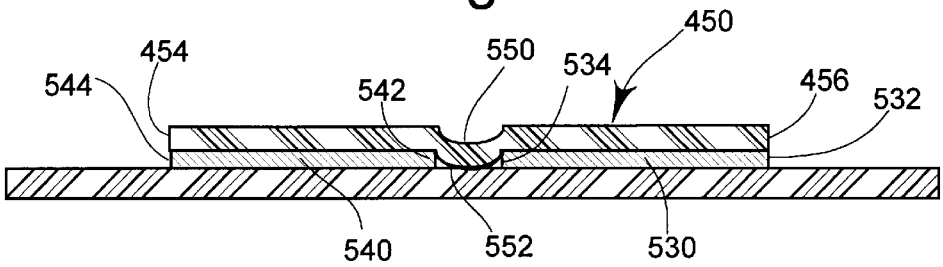
FIG. 9 shows a cross-section side view taken across line 9—9 in FIG. 8 of the web of material of FIG. 8.

It is noted that cross-sectional elevations views in the drawings (e.g., FIGS. 7, 9 and 11) show materials with exaggerated thickness. Such exaggeration is provided for clarity of description. In general, the thickness of materials is less than portrayed in the drawings.

Figure 6:
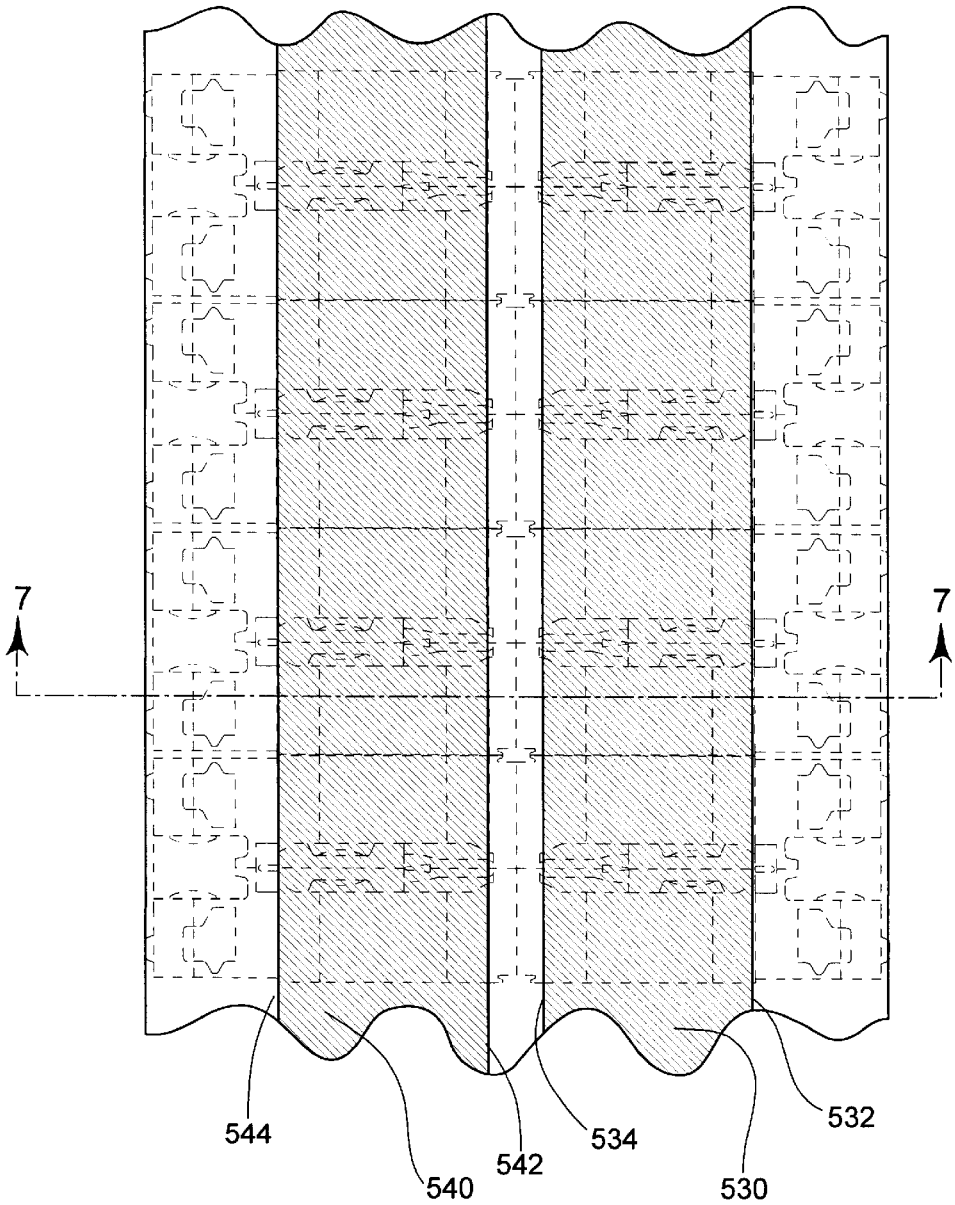
FIG. 6 shows a top plan view of an exemplary web of material having adhesive material applied thereto.
Figure 7:
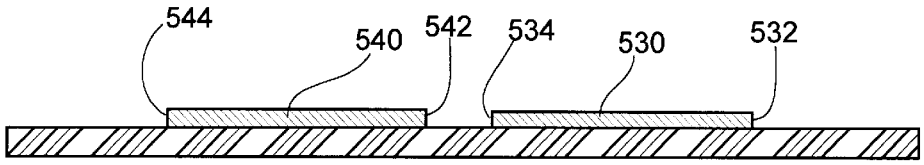
FIG. 7 shows a cross-section side view taken across line 7—7 in FIG. 6 of the web of material of FIG. 6.

With reference to FIG. 4, at the upstream portion 500 of the web processing center 400, the continuous strip of relatively rigid material 422 may be provided from the roll 420. The continuous strip travels down the length of the web processing center 400 in the downstream direction 504, driven by any of a variety of mechanisms well known in the art. The relatively rigid material 422 may receive adhesive from the gravure roll 434. In the present exemplary application, two strips of adhesive material 438 (FIG. 4) may be applied by the two raised surfaces 440, 441 (FIG. 5) as shown in FIGS. 6 and 7. With reference to FIG. 6, the first strip of adhesive material may hereinafter be referred to as a first adhesive strip 530. The second strip of adhesive material may hereinafter be referred to as a second adhesive strip 540. The first adhesive strip 530 may be provided having a first edge 532 and an oppositely disposed second edge 534. The second adhesive strip 540 may be provided having a first edge 542 and an oppositely disposed second edge 544. The edges 532, 534, 542 and 544 correspond to edges of the raised surfaces 440, 441 of the gravure roll 434 (FIG. 5). The first and second adhesive strips 530, 540 travel with the relatively rigid material 422 in the downstream direction 504.

Figure 8:
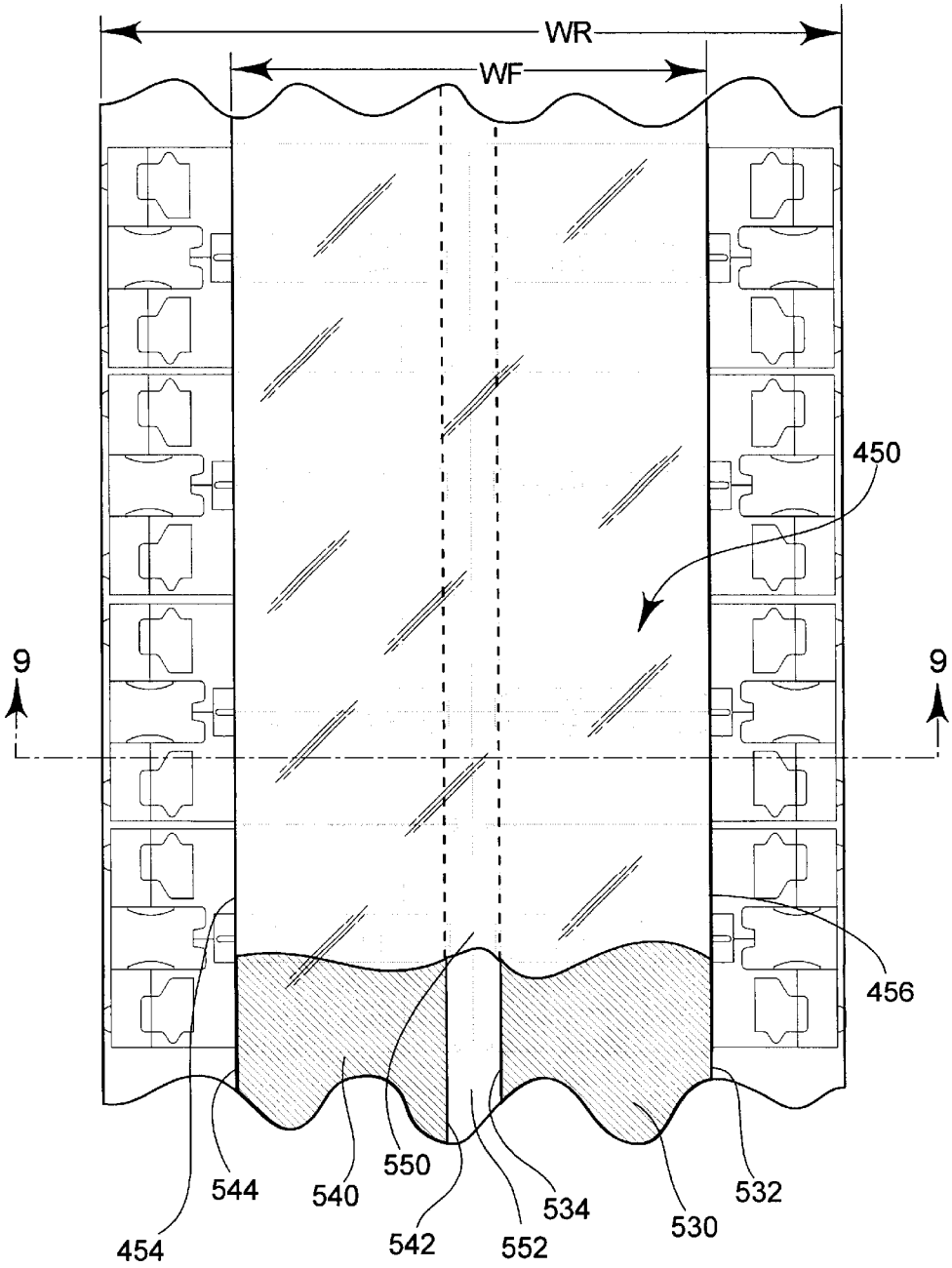
FIG. 8 shows a top plan view of the web of material of FIG. 6 having a relatively fluid impervious material applied thereto.

With reference again to FIG. 4, the relatively rigid material 422 having the adhesive strips 530, 540 applied thereto travels to the location of the relatively fluid impervious material 450. The continuous strip of relatively fluid impervious material 450 may be adhesively attached to the relatively rigid material 422 by the adhesive strips 530, 540. As best shown in FIG. 8, in the particular embodiment shown, the width of the relatively fluid impervious material 450 (denoted by "WF") may result in alignment of the fluid impervious material first edge 456 with the first adhesive strip first edge 532. Additionally, the width of the relatively fluid impervious material 450 may also result in alignment of the fluid impervious material second edge 454 with the second adhesive strip second edge 544. Such configuration further results in a film central portion 550 of the relatively fluid impervious material 450 being adjacent to a web central portion 552 of the relatively rigid material 422. The film and web central portions 550, 552 may reside between the first adhesive strip second edge 534 and the second adhesive strip first edge 542. As previously mentioned and with reference to FIG. 4, the idler pressure applying rolls 458, 460 promote the bonding of the relatively fluid impervious material 450 to the relatively rigid material 422 thereby rendering the assembled web 470.

The assembled web 470 may be further presented to the printing center 408 for receiving graphics. As previously mentioned, the printing center 408 may be located at any of a variety of locations within the web processing center 400 depending on the surface of the assembled web 470 to be printed.

Figure 11:
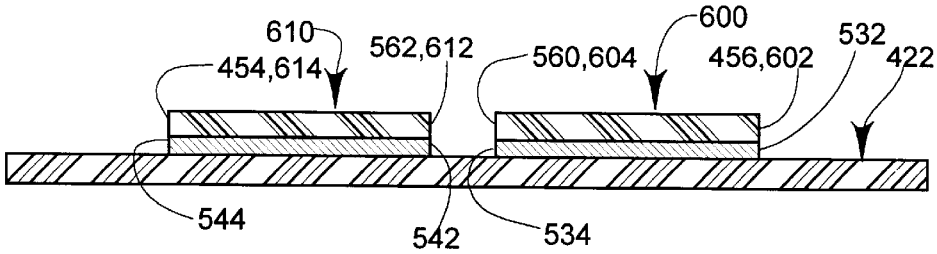
FIG. 11 shows a cross-section side view taken across line 11—11 in FIG. 10 of the web of material of FIG. 10.

With further reference to FIG. 4, the detached film 490 may be removed from the assembled web 470 at the film stripping center 480. As previously described, a cutter such as the rotary knife 482 may make a first cut 560 and a second cut 562 in the relatively fluid impervious material 450. With reference to FIGS. 11 and 12, in the exemplary embodiment shown, the first cut 560 may be aligned with the first adhesive strip second edge 534 and the second cut 562 may be aligned with the second adhesive strip first edge 542. The detached film 490 may be removed from the assembled web 470 and recycled or discarded as previously described.

With reference to FIG. 10, upon removing the detached film 490 (FIG. 4), two strips of the relatively fluid impervious material 450 remain. One strip of the relatively fluid impervious material 450 will hereinafter be referred to as a first film strip 600 and the second strip will hereinafter be referred to as a second film strip 610. The first film strip 600 has a first edge 602 and an oppositely disposed second edge 604. The second film strip 610 has a first edge 612 and an oppositely disposed second edge 614. In the present exemplary application, the first film first edge 602 may be the same as the relatively fluid impervious first edge 456, the first film second edge 604 may be the same as the first cut 560, the second film first edge 612 may be the same as the second cut 562 and the second film second edge 614 may be the same as the relatively fluid impervious second edge 454.

With reference to FIG. 5, after removing the detached film 490 (FIG. 4), the assembled web 450 may be presented to the blanking center 410. As previously described, the blanking center 410 may be utilized to remove individual blanks such as blank 100 from the assembled web 450. Blank 100 is best shown in FIG. 2, wherein the film strip (e.g., 600, 610) is shown as a shaded region. Additionally, FIG. 2 shows unshaded regions that are exposed paperboard portions.

The previous description of producing blanks 100 with the web processing center 400 may yield a plurality of blank 100 (FIG. 2). With particular reference to FIG. 2, the previously mentioned printed film portion 180 may be either the first film strip 600 or the second film strip 610 depending on the side of the assembled web 470 from which the blank 100 was produced. The paperboard portion 182 may be derived from the web center portion 552. The paperboard portion 184 may be derived from a portion of material near either the first or second edge 424, 426 the relatively rigid material 422.

By utilizing this apparatus and method, blanks may be manufactured having certain portions thereof covered with film and other portions thereof not covered with film. Such blanks (and the containers formed therefrom) are advantageous for several reasons. One advantage may be to minimize the usage of the relatively fluid impervious material. The minimization of the relatively fluid impervious material may decrease the cost of raw materials for the containers (i.e., decreasing manufacturing cost). Another advantage may be the ability to use cold glue in the folder/gluer machine. Because exposed paperboard portions (e.g., 182, 184 in FIG. 2) remain uncovered by film, cold glue may be used to erect the container. Such usage of cold glue has been previously discussed; however in review, it may be preferred to use cold glue on exposed paperboard portions (e.g., 182, 184 in FIG. 2) rather than on film portions (e.g., 180 in FIG. 2). The use of cold glue in the folder/gluer machine may increase the speed at which containers may be manufactured because cold glue may be applied faster than hot glue. Increases of speed in the folder/gluer machine may result in increased efficiency, which results in increased profitability.

While illustrative and presently preferred embodiments of the invention have been described in detail herein, it is to be understood that the inventive concepts may be otherwise variously embodied and employed, and that the appended claims are intended to be construed to include such variations, except as limited by the prior art.

I claim:

1. A method of making at least one carton blank, said method comprising:

providing a relatively rigid material comprising:
a first portion;
a first edge and an oppositely disposed second edge defining a first width formed between said first edge and said second edge;

providing a relatively flexible fluid impervious material comprising:
a second portion;
a third edge and an oppositely disposed fourth edge defining a second width formed between said third edge and said fourth edge;
wherein said second width is less than said first width;

adhering said first portion to said second portion, thereby defining a web of material;

separating said at least one carton blank from said web of material;

wherein said providing a relatively rigid material further comprises providing a third portion;

wherein said providing a relatively flexible fluid impervious material further comprises providing a fourth portion; and wherein said third portion is immediately adjacent to said fourth portion but not adhered to said fourth portion.

2. The method of claim 1 and further comprising:

at least partially separating said second portion from said fourth portion.

3. The method of claim 2 wherein said at least partially separating said second portion from said fourth portion comprises at least partially cutting said second portion from said fourth portion.

4. The method of claim 1, wherein:

said providing a relatively rigid material comprises providing a paperboard material.

5. The method of claim 1, wherein:

said providing said relatively flexible fluid impervious material comprises providing a plastic material.

6. The method of claim 5, wherein:

said providing said relatively flexible fluid impervious material comprises a material that is essentially non-compatible with a water based adhesive.

7. The method of claim 1, wherein:

said adhering said first portion to said second portion comprises applying an adhesive that is essentially non-compatible with water.

8. A web of material comprising:

a relatively rigid material comprising:

a first portion;

a second portion adjacent to said first portion;

a first edge and an oppositely disposed second edge defining a first width formed between said first edge and said second edge;

a relatively flexible fluid impervious material comprising:
a third portion;
a fourth portion adjacent to said third portion;

a third edge and an oppositely disposed fourth edge defining a second width formed between said third edge and said fourth edge;

wherein said second width is less than said first width;

wherein said second portion is adhered to said first portion; and wherein said second portion is immediately adjacent to said fourth portion but not adhered to said fourth portion.

9. The web of claim 8, wherein:

said relatively rigid material comprises paperboard.

10. The web of claim 8, wherein:

said relatively flexible fluid impervious material comprises plastic.

11. The web of claim 10, wherein:

said relatively flexible fluid impervious material is non-compatible with a water based adhesive.

12. The web of claim 8, wherein:

said third portion is adhered to said first portion by an adhesive.

13. The web of claim 12, wherein:

said adhesive is non-compatible with water.

* * * * *